United States Patent [19]

Parlanti

[11] 4,420,917

[45] Dec. 20, 1983

[54] GUYLINE TENSION DEVICE FOR COMMUNICATION TOWERS

[76] Inventor: Conrad A. Parlanti, 7182 Rasmussen Ave., Visalia, Calif. 93277

[21] Appl. No.: 334,983

[22] Filed: Dec. 28, 1981

[51] Int. Cl.[3] ..... E04H 12/34

[52] U.S. Cl. ..... 52/123.1; 52/111; 52/117; 254/346

[58] Field of Search ..... 52/111, 118, 123.1, 52/117; 254/213, 233, 346, 350

[56] References Cited

U.S. PATENT DOCUMENTS 2,652,230 9/1953 Hoyle et al. ..... 254/346

3,033,529 5/1962 Pierrat ..... 51/111 X 4,231,200 11/1980 Henderson ..... 52/111

*Primary Examiner*—John E. Murtagh

*Assistant Examiner*—Richard E. Chilcot, Jr.

*Attorney, Agent, or Firm*—Robert G. Slick

[57] ABSTRACT

A guyline tensioner for communication towers is provided wherein the towers are of the type having a plurality of nested sections which are raised and lowered by a telescoping action. The device of the present invention provides a guying means so that as the tower is raised or lowered, a single operator can maintain equal tension on all of the guys at the same time.

6 Claims, 4 Drawing Figures

GUYLINE TENSION DEVICE FOR COMMUNICATION TOWERS

SUMMARY OF THE INVENTION

The present invention relates to nested towers wherein a plurality of sections of the tower telescope, permitting the tower to be raised or lowered. These towers are well-known in the art for such purposes as supports for antennas, microwave relays and the like.

After such a tower is erected, it is ordinarily held steady by a plurality of guy wires, normally three or four. However, during the raising and lowering of such a tower, it is difficult to maintain equal tension on all of the guy wires. It is important that equal tension be maintained, particularly if the tower is raised or lowered during high winds.

In the past, this has required the services of several men to fasten the guy wires to the various anchoring points and to maintain a uniform tension on the cables during the raising or lowering operation. Also, even if several men are employed, it is difficult to coordinate their efforts so that frequently the tension on the various guy wires will be uneven.

The present invention provides a system which uses a winch which is driven through an electromagnetic clutch wherein a change in the current causes a change in the degree of engagement of the magnetic clutch. As a section of the tower is raised from a nested position to raised position, cable is payed from the winch and the clutch keeps the guy wires in tension at all times, yet allows the cable to be payed out from the winch drum. Finally when the tower is fully raised, the magnetic clutch will have the amperage advanced which causes the cable to become fully tensioned. By using a central system of this nature, all of the guy cables are equalized by a lever device connected to a main cable which is wound on the safety winch and all cables are therefore held at the same tension during raising of the tower sections as well as acting as a brake when the sections are fully raised. Further, as will later be explained in detail, the same system permits one to maintain constant tension on all of the guy cables as the tower is lowered.

The system of the present invention also provides a novel equalizing system so that a single winch can be employed to apply equal tension to a plurality of cables, usually three.

Other objects and features of the present invention will be brought out in the balance of the specification.

BRIEF DESCRIPTION OF THE PREFERRED EMBODIMENT

Figure 1:
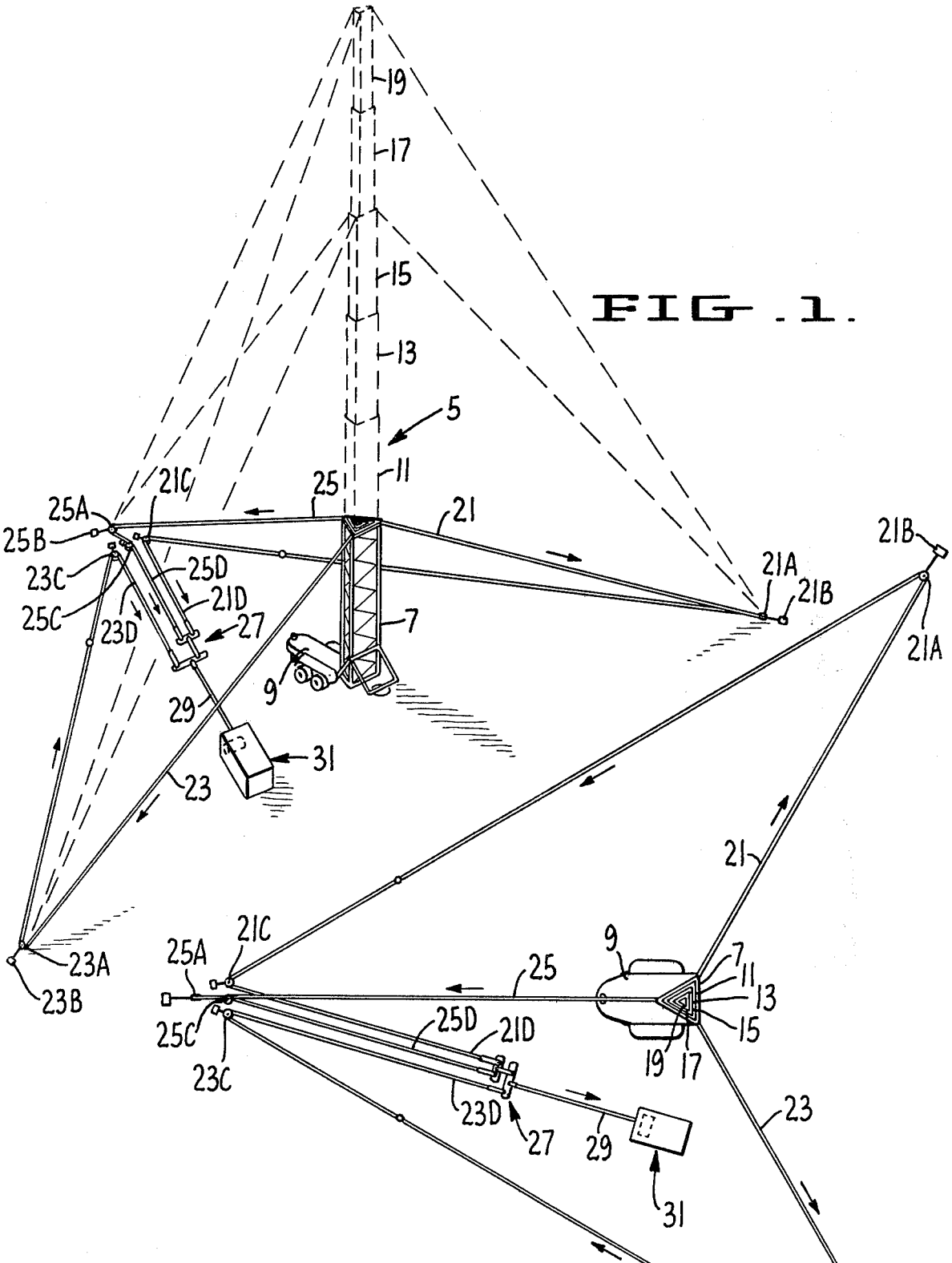
FIG. 1 is a perspective view of a system embodying the present invention.
Figure 2:
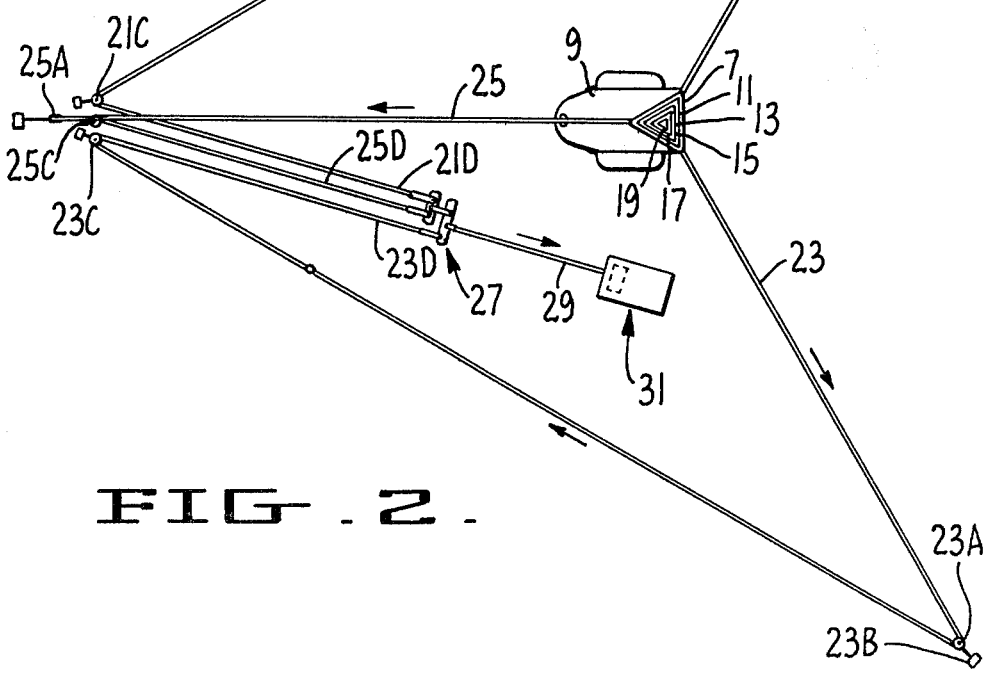
FIG. 2 is a plan view of the system shown in FIG. 1.

Referring now to the drawings by reference characters, there is shown a tower generally designated 5 having a base section 7 which is mounted on a vehicle 9. In the embodiment of the invention illustrated, in addition to the base section 7, there are five nesting sections, shown in phantom, namely, 11, 13, 15, 17 and 19. The structure thus far described is well-known to those skilled in the art and normally all of the sections would be nested within the base section 7 which would be placed horizontally on the vehicle 9 and hauled to a desired site. When it is desired to erect the antenna, the base section 7 would be raised to a vertical position and then the other sections, namely, 11, 13, 15, 17 and 19 would be raised by well-known winch means, not illustrated.

The problem with erecting such an antenna is that antennas of any substantial height must be guyed and that equal tension must be maintained on the various guys as the antenna is raised. As was pointed out above, this has ordinarily required the services of a number of people and even then it is subject to human judgment and error so that one has no assurance that the guys have equal tension.

In raising the tower, three cables, namely, 21, 23 and 25 are attached to the section or sections to be raised. Each of these cables is attached to a pulley and ground anchor and around a fixed pulley, each being designated with the corresponding number followed by A, B, and C, respectively, while the opposite ends of each of the cables, designated by the number followed by the letter D, are attached to the equalizing device generally designated 27. Equalizing device 27 is attached by a single cable 29 to the safety winch device generally designated 31.

Figure 3:
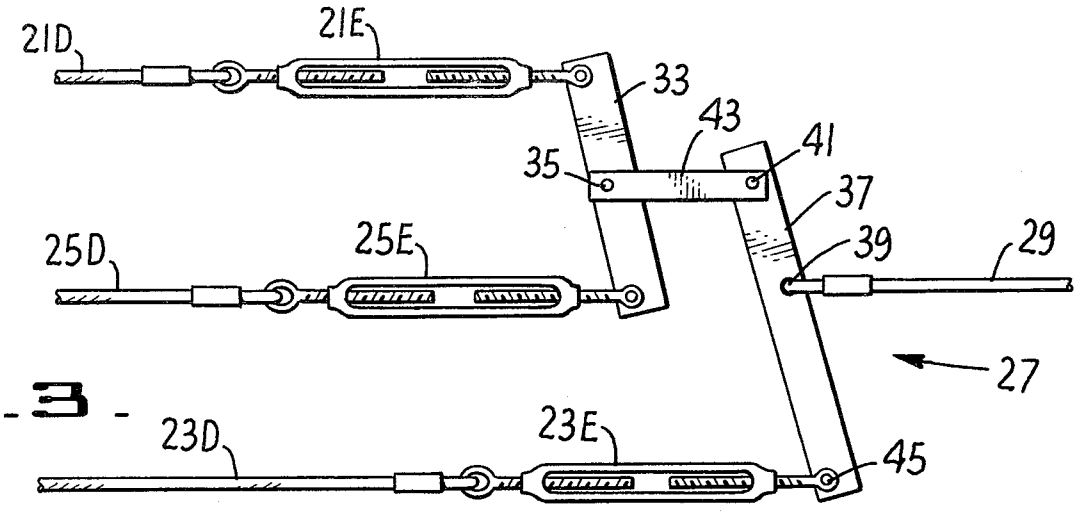
FIG. 3 is an enlarged plan view of the equalizing device employed in carrying out the present invention.
Figure 4:
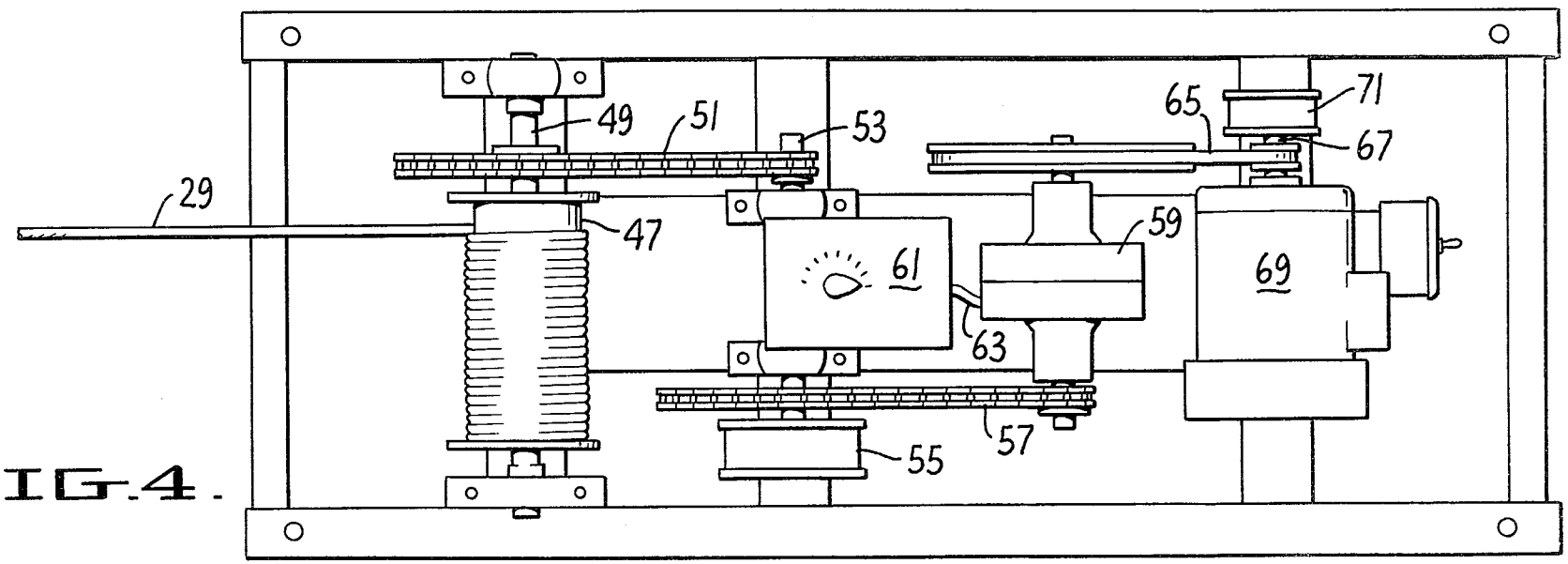
FIG. 4 is an enlarged view of the winch and control mechanism employed in carrying out the present invention.

As is best seen in FIG. 3, the equalizing device includes a first lever arm 33 which is pivoted at the center, namely point 35. The cables 21D and 25D are pivoted at the opposite ends of arm 33 and equidistant from center pivot 35. Thus, it is obvious that any force exerted at the pivot point 35 will be transmitted equally to the guy cables 21D and 25D.

A second lever arm 37 is employed which is pivoted at point 39 to the main cable 29. The ends of arm 37 are pivoted at point 41 to the pivot 35 through a connector 43 while the opposite end of the arm is pivoted at point 45 through the cable 23D. However, the distance from pivot points 39 to 41 is exactly half of the distance between pivot point 39 and point 45, thus forming a first class lever so that a constant pull on cable 29 will exert twice the pull at 41 that it does at point 45. Thus, the pull on all three cables, namely, 21, 23 and 25 will be equal.

Although not strictly necessary, it is preferred that the cables be attached through turnbuckles 21E, 23E and 25E, which is particularly important during the setup of the cabling system.

Referring now to the cable control device 31, this includes a winch drum 47 around which cable 29 is wrapped. Drum 47 is mounted for rotation on shaft 49 which is connected by a roller chain 51 to shaft 53 on which is mounted a fail safe brake 55. The fail safe brake 55 is one wherein the brake is off when it is energized. Should the electric circuit fail, it is automatically applied. Shaft 53 is coupled through a second roller chain 57 to one side of an electromagnetic clutch 59 wherein the degree of engagement of the clutch is controlled by a control box 61 coupled by a cable 63 to the clutch. The opposite side of the clutch is coupled through a belt 65 to a shaft 67. A motor 69 and a second fail safe clutch 71 are attached to the shaft 67.

When the tower is being raised, motor 69 is turned off and clutch 71 is engaged. Since the shaft 67 is thus locked, this means that the electromagnetic clutch 59 serves a tensioning device so that as the tower is being raised, paying out cable 29, the cable 29, and thus the guy wires, are kept under tension, the amount of the tension being determined by the degree of engagement of the electromagnetic clutch 59, regulated through the control box 61. Of course, the amount of tension can be increased or decreased by varying the control voltage to the clutch 59. Since the cable 29 acts through the equalizing device 27, tension on all three cables is maintained at a desired level while the tower is being raised.

When the tower attains its full height, the power to the motor 61 and clutch 71 are still off and power is then cut off to the fail safe brake 55, locking shaft 53. The tower is now fully erected and for a temporary situation the system would be left as is. For a permanent installation the guy wires would be fastened directly to ground anchors in the usual manner.

When it is desired to lower the tower, motor 69 is turned on and fail safe clutch 71 is released as well as the fail safe brake 55. Motor 69 now winds cable 29 on drum 47 acting through clutch 59, thus, as the tower is lowered, the desired tension is maintained on the cable 29 by adjusting the voltage on the magnetic clutch 59. In this manner constant tension is maintained on the cable as the tower is lowered.

In the foregoing description of the invention, it has been assumed that a single set of guy cables is to be employed. However, as is shown in FIG. 1, multiple guys are frequently necessary in which case the equipment thus described would be replicated, depending upon a number of the sets of guying cables.

Although a preferred embodiment of the invention has been described, it will be obvious to those skilled in the art that many variations can be made without departing from the spirit of this invention.

I claim:

1. A cabling system for raising and lowering a nesting tower structure comprising:

at least three ground anchors set out from and peripherally around a nesting tower structure; at least one pulley secured to each of said ground anchors; a like number of cables, one end of each cable being secured to the tower structure and trained around one of said pulleys; and means for tensioning said cables and maintaining a preselected tension on said cables as said tower structure is raised or lowered, said means for equalizing the tension in each of said cables comprising a pair of first class levers, one lever connected at a center fulcrum point to a pivot on the other, the tension forces of two cables being applied equal distances from and on opposite sides of said fulcrum point, the pivotal connection to said second lever acting with a moment arm relative to the fulcrum point on said second lever to balance the tensioning force of a third cable connected to a second pivot point on said second lever and having a fourth cable attached to the fulcrum point of said second lever whereby tension on said fourth cable will be applied equally to the first three cables.

2. The system of claim 1 wherein three ground anchors are employed.

3. The cabling system of claim 1, including means for equalizing the tension in each of said cables as said tower structure is raised or lowered.

4. The cabling system of claim 1, and further comprising a plurality of turnbuckles connecting each of said cables to said first and second levers.

5. The apparatus of claim 1, said tensioning means comprising a winch drum and means for rotating said drum including a voltage actuated magnetic clutch, the tensioning force applied to said winch drum being adjustable by increasing or decreasing the voltage on said clutch.

6. The cabling system of claim 1 having the following in combination:

a. a winch on which said fourth cable is adapted to be wound, b. an electric motor in driving arrangement with said winch through an electric clutch, c. control means for locking said motor, d. control means for controlling the degree of engagement of said electric clutch whereby:

1. said motor can be locked and said electric clutch controls the tension on the fourth cable as the cable is payed out and
2. said motor can be activated and said electric clutch controls the tension on said fourth cable as said cable is wound in.

* * * * *